US008338331B2

(12) United States Patent
Horii et al.

(10) Patent No.: US 8,338,331 B2
(45) Date of Patent: Dec. 25, 2012

(54) SHEET FOR THERMAL TRANSCRIPTION

(75) Inventors: Akihiro Horii, Miyagi (JP); Tomoko Haga, Miyagi (JP); Daigo Koide, Saitama (JP); Hirokazu Okada, Saitama (JP)

(73) Assignees: Sony Corporation, Tokyo (JP); Fujikura Kasei Co., Ltd., Tokyo (JP)

( * ) Notice: Subject to any disclaimer, the term of this patent is extended or adjusted under 35 U.S.C. 154(b) by 945 days.

(21) Appl. No.: 11/719,625

(22) PCT Filed: Nov. 17, 2005

(86) PCT No.: PCT/JP2005/021113

§ 371 (c)(1),
(2), (4) Date: May 11, 2009

(87) PCT Pub. No.: WO2006/057192

PCT Pub. Date: Jun. 1, 2006

(65) Prior Publication Data

US 2009/0220709 A1 Sep. 3, 2009

(30) Foreign Application Priority Data

Nov. 24, 2004 (JP) ..... P2004-339278

(51) Int. Cl.
*B41M 5/40* (2006.01)

(52) U.S. Cl. ..... 503/227; 428/32.39

(58) Field of Classification Search ..... 503/227; 428/32.39, 32.5

See application file for complete search history.

(56) References Cited

U.S. PATENT DOCUMENTS 5,258,355 A * 11/1993 Bloodworth et al. ..... 503/227
6,048,822 A 4/2000 Asai

FOREIGN PATENT DOCUMENTS

| | | |
|---|---|---|
| JP | 04-319489 | 11/1992 |
| JP | 07-068948 | 3/1995 |
| JP | 07-117371 | 5/1995 |
| JP | 9-67432 | 3/1997 |
| JP | 09-067432 | 3/1997 |
| JP | 09-234893 | 9/1997 |
| JP | 09-267571 | 10/1997 |
| JP | 10-060063 | 3/1998 |
| JP | 10-272845 | 10/1998 |

OTHER PUBLICATIONS

International Search Report dated Jan. 17, 2006.
Japanese Patent Office Action corresponding to Japanese Serial No. 2006-547742 dated May 10, 2011.

* cited by examiner

*Primary Examiner* — Gerard Higgins
(74) *Attorney, Agent, or Firm* — SNR Denton US LLP

(57) ABSTRACT

A sheet for thermal transcription including a substrate (2) and a receiving layer (3) formed on the substrate (2) for receiving a dye. The receiving layer (3) contains a graft polymer of at least one monomer out of acrylic monomers and methacrylic monomers and at least one polyester sort. The sheet for thermal transcription assures satisfactory printing density and satisfactory adhesion performance with respect to a laminate film, while preventing image bleeding or fading and assuring stabilized running performance. Thus, it is possible to generate an image of high quality and high resolution.

7 Claims, 1 Drawing Sheet

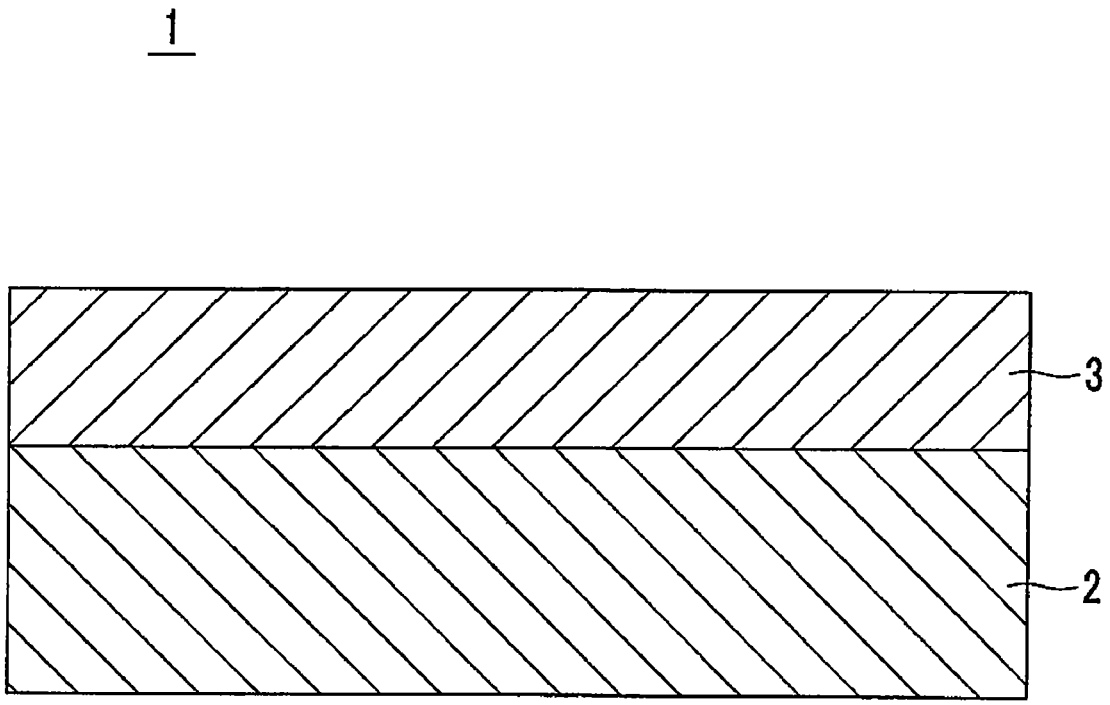
1
3
2

SHEET FOR THERMAL TRANSCRIPTION

TECHNICAL FIELD

This invention relates to a sheet for thermal transcription for a dye.

This application asserts the rights of priority based on the Japanese Patent Application No. 2004-339278, which was filed in Japan on Nov. 24, 2004, and which is to be incorporated by reference herein.

BACKGROUND ART

To a sheet for thermal transcription, a dye containing a sublimable dispersion dye is thermally transferred from a thermal transcription sheet, by a thermal head, and an image is formed on the sheet for thermal transcription by the so transferred dye. On the thermal transcription sheet, there are provided yellow, magenta and cyan dyes for each image, followed by a laminate film for protecting the image, for extending in a row along the running direction. An image is formed by thermal transcription of yellow, magenta and cyan, on the sheet for thermal transcription, and finally the laminate film is thermally transferred to the so formed image.

The sheet for thermal transcription includes a sheet-like substrate, and a receiving layer formed on the substrate to receive thermally transferred dyes (see Patent Publications 1 and 2, for example). The substrate is a film of plastics, such as, for example, polyethylene terephthalate (PET), polypropylene (PP) or polyethylene (PE), or a sheet of synthetic paper, coat paper, art paper or cast coat paper. The film or the sheet may be used alone or a plural number of the films or sheets may be stuck together (see Patent publication 3, for example).

The receiving layer formed on the substrate receives the dyes transferred from the thermal transcription sheet to hold the so received dyes. The receiving layer is formed of a dyeable resin, such as acrylic resins, polyesters, polycarbonates or polyvinyl chloride.

The receiving layer, composed of the dyeable resin, is added by e.g. polyisocyanate, as a curing agent, and also as a thermal resistance improver. The receiving layer is also added by a plasticizer for improving the transfer sensitivity of the dye and suppressing the fading, that is, for improving light fastness. A silicone oil, for example, is added as mold release agent to the receiving layer for improving its detachment performance.

The receiving layer of the sheet for thermal transcription is required to allow for good running performance and image saving performance, under high temperature conditions, at the same time as it allows for high printing density, light fastness and good transfer performance for the laminate film adapted for protecting the transcribed dyes.

If only the aforementioned acrylic resin is used as a resin of the receiving layer, the transfer performance of the laminate film and the detachment performance of the thermal transcription sheet are optimum. However, in this case, the dye is not optimum in dyeability such that it is difficult to obtain a satisfactory printing density. Also, if only the aforementioned acrylic resin is used as a resin of the receiving layer, there are cases where the response to an external stress is poor and cracks tend to be produced on bending the sheet for thermal transcription.

On the other hand, if only the aforementioned polyester is used as the resin of the receiving layer, sufficient printing density may be obtained because of high dyeability of the dye. However, in this case, the amount of the functional groups reacting with the curing agent becomes extremely small, so that it becomes necessary to add an excess amount of the curing agent to generate cross-linking in the receiving layer to allow for satisfactory running performance under high temperature conditions. However, if the curing agent is added excessively, the printing density or the light fastness is lowered to deteriorate transfer properties of the laminate film.

If the acrylic resin is used as a resin of the receiving layer, there are cases where the amount of addition of the curing agent is decreased and the plasticizer is added to lower the glass transition temperature to provide for excess softening of the receiving layer such as to improve the printing density. If the receiving layer is softened excessively, the printing density is optimum and the dye is diffused sufficiently to improve light fastness and transfer properties of the laminate film. However, if, in this case, the image is stored under high temperature conditions, the dye is diffused in the in-plane direction as well to cause bleeding in the image. Moreover, if the receiving layer is softened excessively, the receiving layer is fused to the dye surface of the thermal transcription sheet, thus lowering the detachment performance of the thermal transcription sheet. If the thermal transcription sheet is lowered in the detachment performance, the image formed may be deteriorated in dignity or defects such as running troubles may be produced.

Since the thermal transcription sheet is heated to higher temperatures for increasing the speed of thermal transcription, high heat is supplied to the sheet for thermal transcription, thus further lowering the detachment performance of the thermal transcription sheet to cause defects such as running troubles.

Thus, in the sheet for thermal transcription, there are cases where the amount of addition to the receiving layer of polyisocyanate as the curing agent is increased to cause excessive curing of the receiving layer in order to improve the running performance or thermal resistance under high temperature conditions and in order to prevent the image bleeding. However, if the receiving layer is cured excessively, the transfer sensitivity and the printing density are lowered severely. If the receiving layer is cured excessively, the receiving layer is not softened with heat generated at the time of thermal transfer, thus causing troubles in transferring the laminate film. Moreover, if the receiving layer is cured excessively, it may occur that the dye is not diffused sufficiently and light fastness is lowered.

If the resin in the sheet for thermal transcription comprises only polyester, and the dyes of yellow, magenta and cyan are sequentially overlaid and thermally transferred, the dye already transferred to the receiving layer may be prevented from being moved back to the thermal transcription sheet. However, if only the polyester is used as the resin, light fastness is poor, and the upper layer dye of the layered dyes tend to undergo fading, thus deteriorating the image.

Thus, it is difficult to provide such a receiving layer of the sheet for thermal transcription which will assure high printing density, high adhesion performance of the laminate film and high running performance, prevent the image bleeding or fading, and which will yield an image of high quality and high resolution, all the more so in case printing is carried out under high temperature conditions, as in the case of high speed transcription.

| | |
|---|---|
| Patent Publication 1 | JP Laid-Open Patent Publication H7-117371 |
| Patent Publication 2 | JP Laid-Open Patent Publication H7-68948 |
| Patent Publication 3 | JP Laid-Open Patent Publication H9-267571 |

DISCLOSURE OF THE INVENTION

It is an object of the present invention to provide a sheet for thermal transcription with which it is possible to solve the aforementioned problems of the related art.

It is another object of the present invention to provide a sheet for thermal transcription with which it is possible to allow for an optimum printing density and optimum adhesion performance, to prevent image bleeding or fading, and to allow for the stable running performance.

For accomplishing the above object, the present invention provides a sheet for thermal transcription comprising a substrate, and a receiving layer formed on the substrate for receiving a dye, with the receiving layer containing a graft polymer of at least one monomer out of acrylic monomers and methacrylic monomers, and at least one polyester sort.

According to the present invention, in which a graft polymer of at least one monomer out of acrylic monomers and methacrylic monomers and at least one polyester sort is contained in the receiving layer, it is possible to provide for the optimum detachment performance of the thermal transcription sheet and optimum adhesion of the laminate film and to prevent the running performance from being lowered as well as to prevent the dye from fading. In addition, according to the present invention, the polyester component improves transfer sensitivity and optimizes the printing density, while suppressing the dye from being diffused in the in-plane direction and preventing the image from bleeding. Thus, according to the present invention, the optimum printing density, optimum adhesion performance of the laminate film and the stabilized running performance may be achieved and the image bleeding or fading may be suppressed to enable an image to be formed to high quality and to high resolution.

Other objects and advantages derived from the present invention will become more apparent from the following description which will now be made in conjunction with the accompanying drawings.

BRIEF DESCRIPTION OF THE DRAWINGS

FIG. 1 is a cross-sectional view showing a sheet for thermal transcription according to the present invention.

BEST MODE FOR CARRYING OUT THE INVENTION

Referring to the drawings, a sheet for thermal transcription according to the present invention will be described in detail. A sheet for thermal transcription 1, shown in FIG. 1, is used for a thermal transcription printer in which a thermal transcription sheet includes a dye layer and a laminate film layer. The dye layer comprises sublimable dispersion dyes of yellow, magenta and cyan. In forming a color image on the sheet for thermal transcription 1, in the thermal transcription printer, the sheet for thermal transcription 1 is transported to a position facing the thermal transcription sheet. The dye layers of the thermal transcription sheet are compressed against the sheet for thermal transcription 1, so that the dye layers will be overlaid sequentially, as the dye layers are heated by the thermal head. The respective dyes are overlaid and transcribed to create other colors. The transcribed dyes are transferred to the laminate film to generate a color image.

The sheet for thermal transcription 1, a sheet to which are transcribed the dyes, is of a dual layer structure made up of a substrate 2 and a receiving layer 3 adapted for receiving the dyes. The substrate 2 is a sheet, as an example, and holds the receiving layer 3 formed on one of its major surfaces. The receiving layer 3, arranged as an uppermost surface layer, has dye layers on the thermal transcription sheets selectively transcribed thereto, and receives the so transcribed dyes.

Specifically, the substrate 2 may be a film of plastics, such as, for example, polyethylene terephthalate (PET), polypropylene (PP) or polyethylene (PE), or a paper sheet, such as a sheet of synthetic paper, art paper, cast coat paper or high-quality paper. Or, the substrate may be formed by a film of plastics and the paper sheets bonded together. This substrate 2 is high in tenacity so that it is not ruptured during handling, while it withstands the heat of the thermal head when the dye is transcribed to the receiving layer 3.

The surface of the substrate 2, opposite to the surface of the substrate carrying the receiving layer 3, may be provided with a backing layer, not shown. This backing layer controls the frictional coefficient between the sheet for thermal transcription 1 and a transport mechanism to allow the sheet for thermal transcription 1 to travel in stability through the inside of a thermal transcription printer.

The receiving layer 3 receives dye layers selectively transcribed thereto from the thermal transcription sheet. The receiving layer 3 is formed of a thermoplastic resin, a thermosetting resin or a UV setting resin that may be dyed with the transcribed dyes. The receiving layer 3 is 1 to 10 μm and preferably 3 to 8 μm thick. If the thickness of the receiving layer 3 is less than 1 μm, the quantity of the dye that can be received becomes smaller, thus lowering the printing density. If the thickness of the receiving layer 3 is larger than 10 μm, the transcription sensitivity is lowered, thus again lowering the printing density.

In the receiving layer 3, there is contained, in addition to the aforementioned resins, a graft polymer of one or more monomers, out of the acrylic and methacrylic monomers, and one or more of polyesters. With the receiving layer 3, containing this graft polymer, it is possible to satisfy the requirements for printing density and adhesion characteristics of the laminate film, to prevent image bleeding or fading and to provide for smooth detachment of the thermal transcription sheet, thus achieving the stable running performance.

Specifically, the main chain of the graft copolymer is one or more monomers, out of the acrylic and methacrylic monomers, whereas its side chain is one or more polyesters. The acrylic and methacrylic monomer, as a main chain, prevents a dye surface of the thermal transcription sheet, provided with the dye layers, from being fused with the receiving layer 3, thereby improving the detachment performance of the thermal transcription sheet. Hence, the thermal transcription sheet may be promptly detached from the sheet for thermal transcription 1, under high temperature conditions, subsequent to dye transcription, with the result that the sheet for thermal transcription 1 may travel in stability through the inside of the thermal transcription printer. The acrylic or methacrylic monomer serves for improving adhesion characteristics of the laminate film, which protects the dye transcribed to the receiving layer 3, and for improving transcription characteristics of the laminate film. The acrylic monomer or the methacrylic monomer also improves light fastness of the receiving layer 3 and prevents the dye from fading while suppressing image deterioration.

As the acrylic monomer or the methacrylic monomer, use may be made of, for example, hydroxy ethyl acrylate or hydroxy ethyl methacrylate, referred to below sometimes as hydroxylethyl meth(acrylate), represented by the following chemical formula (1):

[Chemical Formula 1]

(1)

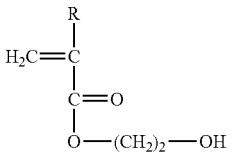

where R denotes H or $CH_3$;

or of 2-hydroxy-3-phenoxypropyl acrylate or 2-hydroxy-3-phenoxypropyl methacrylate, referred to below sometimes as 2-hydroxy-3-phenoxypropyl (meth)acrylate, represented by the following chemical formula (2):

[Chemical Formula 2]

(2)

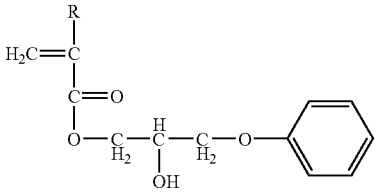

where R denotes H or $CH_3$.

With the hydroxylethyl meth(acrylate) or 2-hydroxy-3-phenoxypropyl (meth)acrylate, it is possible to further improve the adhesion performance of the laminate film to the receiving layer 3 and the detachment performance of the thermal transcription sheet. Moreover, a graft polymer of hydroxylethyl meth(acrylate) or 2-hydroxy-3-phenoxypropyl (meth)acrylate with polyester may be improved in its reactivity with a curing agent due to an increased amount of the functional groups in the graft polymer.

In particular, out of the compounds represented by the chemical formulas (1) and (2), hydroxylethyl methacrylate, represented by the chemical formula (1), has a glass transition temperature of 55° C., whereas 2-hydroxy-3-phenoxypropyl acrylate, represented by the chemical formula (2), has a glass transition temperature of 28° C. In case hydroxylethyl methacrylate, shown by the chemical formula (1), is contained in the receiving layer 3, the resulting receiving layer shows higher thermal resistance on curing than in case 2-hydroxy-3-phenoxypropyl acrylate, represented by the chemical formula (2), is contained in the receiving layer, thereby preventing the receiving layer 3 from becoming liable to be fused.

In addition to the acrylic monomers or methacrylic monomers, shown by the chemical formulas (1) and (2), methyl acrylate, ethyl acrylate, cyclohexyl acrylate, isoboronyl acrylate, tertiary butyl acrylate, phenoxy acrylate, phenoxy ethyl acrylate, methyl methacrylate, ethyl methacrylate, cyclohexyl methacrylate, isopboronyl methacrylate, tertiary buthyl methacrylate, phenoxy methacrylate or phenoxyethyl methacrylate, may be used. Specifically, at least one of these compounds may be contained in the receiving layer 3. The acrylic monomer has the glass transition temperature lower than that of the methacrylic monomer, and hence helps improve the sensitivity of the receiving layer 3 further.

In one or more monomers, graft-polymerized with polyester, the ratio of parts by weight of hydroxyethyl (meth)acrylate, shown by the chemical formula (1), to parts by weight of other acrylic or methacrylic monomers, may range between 5 parts by weight: 95 parts by weight and 50 parts by weight: 50 parts by weight. In similar manner, the ratio of parts by weight of 2-hydroxy-3-phenoxypropyl (meth)acrylate, shown by the chemical formula (2), to parts by weight of other acrylic or methacrylic monomers, also may range between 5 parts by weight: 95 parts by weight and 50 parts by weight: 50 parts by weight.

If the parts by weight of hydroxyethyl (meth)acrylate or 2-hydroxy-3-phenoxypropyl (meth)acrylate are less than 5, these monomers are less liable to be graft polymerized with polyester. Hence, the amount of the functional groups in the graft polymer is decreased, with the result that the graft polymer is hardly liable to react with a curing agent. If the parts by weight of the monomers are greater than 50, graft polymerization of the monomers with polyester occurs sufficiently so that the amount of the functional groups in the graft polymer is increased and the graft polymer reacts sufficiently with the curing agent. However, there are occasions where the graft polymer is hardly soluble in an organic solvent or becomes higher in polarity with whitening of the surface of the receiving layer 3.

The polyester as the side chain helps improve the transcription sensitivity while optimizing the printing density. It also prevents the dye from being diffused in the in-plane direction under high temperature conditions, while suppressing image bleeding.

The polyester may be exemplified by aromatic polyester, aliphatic polyester and alicyclic polyester, which may be present either alone or in combination. For graft polymerization, the polyester is used in an amount of not less than 5 parts by weight and not more than 50 parts by weight to 100 parts by weight of one or more monomers out of the acrylic or methacrylic monomers. In case the amount of the polyester is less than 5 parts by weight, there are cases where the dye is insufficient in its dyeing performance and the receiving layer 3 is low in transcription sensitivity, with the result that printing density may not be optimum. In case the amount of the polyester is less than 5 parts by weight, the proportion of the acrylic monomer and the methacrylic monomer becomes higher. It may occur that, after the receiving layer 3 is coated on the substrate 2, the response to stress of the receiving layer 3 becomes poor with the result that the receiving layer 3 tends to crack on bending the sheet for thermal transcription 1.

If conversely the amount of polyester is more than 50 parts by weight, the amount of the functional groups that may react with the curing agent is decreased, with the result that the receiving layer 3 is not cured sufficiently. Thus, the dye transcribed under high temperature conditions becomes fused to the dye surface of the thermal transcription sheet. In such case, it may become difficult to detach the sheet, thus lowering the running stability.

On the other hand, polyester has a number average molecular weight on the order of 1000 to 2000. Use of an aliphatic polyester with the glass transition temperature of −80° C. to −30° C. leads to higher printing density. It is noted that such polyester with a hydroxyl value of 28 to 224 mgKOH/g is desirable since it leads to an improved efficiency in graft polymerization with the monomer.

The weight average molecular weight of the graft polymer of one or more of acrylic monomers or methacrylic monomers and one or more of polyesters is 10000 to 1000000 and preferably 50000 to 250000. If the weight average molecular weight of the graft polymer is too low, the graft polymer may be brittle, and hence the receiving layer 3 formed of the graft polymer tends to be deteriorated in film coating properties. With too high a weight average molecular weight of the graft polymer, the coating material containing this graft copolymer is increased in viscosity, with the result that it cannot be coated with ease on the substrate 2.

There is no particular limitation to a method for graft polymerization of the aforementioned monomers and the polyesters. For example, there is such a method in which a radical generating type polymerization initiator, exemplified by peroxides, is used, one or more of the acrylic monomers or methacrylic monomers are polymerized, in the presence of one or more polyesters, and a hydrogen extraction reaction by a polymerization initiator is carried out. In another method for graft polymerization, unsaturated groups resulting from radical polymerization are appended at the outset to hydroxyl groups, contained in the polyester, and the resulting product is reacted with one or more of acrylic monomers or methacrylic monomers to yield a graft polymer. In still another method for graft polymerization, functional groups, capable of reacting with hydroxyl groups, are introduced at the outset into one or more acrylic or methacrylic monomers, and the resulting product is then subjected to an addition reaction for addition to a hydroxyl group contained in one or more polyesters. The desired graft polymers may also be obtained using any other suitable methods routinely used.

There is no particular limitation to the method for polymerization of a plural number of acrylic or methacrylic monomers. That is, any suitable polymerization methods, exemplified by suspension polymerization, solution polymerization, emulsion polymerization or block polymerization, may be used to obtain a targeted polymer. Of these, the solution polymerization is most desirable since it allows smoother polymerization.

The receiving layer 3 contains a graft polymer, the main chain of which is one or more acrylic and methacrylic monomers, and the side chain of which is one or more polyesters. The acrylic and methacrylic monomers of the main chain play the role of improving the detachment performance of the thermal transcription sheet and the running performance under high temperature conditions, as well as adhesion characteristics of the laminate film, and preventing fading of the dye. The polyester of the side chain plays the role of improving the printing density and suppressing image bleeding under high temperature conditions. Thus, with the sheet for thermal transcription 1, it is possible to meet the demand for printing density or adhesion performance of laminate films, and to prevent image bleeding or fading, while it is also possible to provide for optimum detachment performance of the thermal transcription sheet and stabilized running properties. Hence, an image formed may of high quality and high resolution.

Moreover, inorganic pigments, such as titanium oxide, calcium carbonate or zinc oxide, or fluorescent whitening agents, may be added to the receiving layer 3 to improve its whiteness.

Mold release agents may further be added to the receiving layer 3. The mold release agents may be enumerated by silicone oils, such as methylene styrene modified silicone oil, olefin modified silicone oil, polyether modified silicone oil, fluorine modified silicone oil, epoxy modified silicone oil, carboxy modified silicone oil or amino modified silicone oil, and fluorine-based mold release agents.

The receiving layer 3 may be added by a curing agent for improving film characteristics. As the curing agent, epoxy- or isocyanate-based curing agents may be used. Of these, non-yellowing type poly-functional isocyanate compounds are preferred. These poly-functional isocyanate compounds may be exemplified by hexamethylene diisocyanate (HDI), xylene diisocyanate (XDI), toluene diisocyanate (TDI) and biurette, which may be used either alone or in combination.

The receiving layer 3 may be added by or coated with an antistatic agent for preventing generation of static electricity during running in the thermal transcription printer. The antistatic agent may be exemplified by a cationic surfactant (e.g. a quaternary ammonium salt or a polyamine derivative), an anionic surfactant (e.g. alkylbenzene sulfonate or an alkyl sulfate sodium salt), an amphoteric ion type surfactant and a non-ionic surfactant.

The receiving layer 3 may be added by a plasticizer, as necessary. The plasticizer may, for example, be phthalates, adipates, trimellitates, pyromellitates or polyphenol esters. The receiving layer 3 may also be added by ultraviolet absorbers or antioxidants for improving preservation properties.

As ultraviolet absorbers, benzophenone based, diphenyl acrylate based or benzotriazole based compounds, for example, may be used. As antioxidants, phenol based, organic sulfur phosphate based or phosphoric acid based compounds may be used.

EXAMPLES

Preferred examples of the present invention will now be described, based on experimental results.

Example 1

In Example 1, a graft polymer was initially prepared. Specifically, 150 parts by weight of methylethylketone, as a solvent, were charged into a reaction vessel, equipped with a stirrer, a thermometer, a nitrogen inlet pipe, and with a reflux cooler. To 25 parts by weight of KURARE-POLYOL N-2010, an aliphatic polyester with a number average molecular weight of 2000, manufactured by KURARE Co. Ltd., as polyester, 2-methacryloyl oxyethyl isocyanate for introducing unsaturated groups into polyester was added, and the resulting mass was agitated homogeneously for mixing. The solution containing KURARE-POLYOL N-2010 and 2-methacryloyl oxyethyl isocyanate was maintained at a temperature of 75° C. and subjected to an addition reaction for eight hours.

100 parts by weight of methyl methacrylate, as a metacrylic monomer, and 1.0 part by weight of azobis isobutyronitrile, as a polymerization initiator, were added to the resulting solution, and the resulting mass was agitated for mixing. The atmosphere within the reactor was replaced with a nitrogen gas and reaction was continued for eight hours as the solution was maintained at a temperature of 75° C.

1.0 part by weight of azobis isobutyronitrile was then added to the solution and, as the temperature within the reactor was maintained at 75° C., the reaction was continued for four hours. The reaction mass was then diluted with 150 parts by weight of methylethylketone to yield a resin formed of a graft polymer of methyl methacrylate and aliphatic polyester.

A coating solution for forming the receiving layer, which is to be coated on the substrate, was then prepared. Specifically, the coating solution for forming the receiving layer was prepared by mixing 100 parts by weight of the graft polymer resin obtained, 5 parts by weight of SF8427, a carbinol modified silicone oil manufactured by Toray-Dow Corning, as a mold release agent, 10 parts by weight of N-75, an HDI based polyisocyanate manufactured by NIPPON POLYURETHANE Co. Ltd., as a curing agent, 200 parts by weight of methylethylketone, as a solvent, and 200 parts by weight of toluene.

A sheet for thermal transcription was then prepared. The coating solution for forming the receiving layer was coated on YUPO FPG-150, a synthetic paper sheet manufactured by OJI YUKA Company Ltd., 150 μm thick, provided as a substrate sheet, to a dry thickness of 5 μm. The sheet thus prepared was dried for two minutes at 120° C. and cured at 50° C. for 48 hours to produce a sheet for thermal transcription.

Example 2

In Example 2, a sheet for thermal transcription was prepared in the same way as in Example 1, except using, as a resin contained in the receiving layer, a resin of a graft polymer, obtained on graft polymerization of 25 parts by weight of the same aliphatic polyester as that of Example 1, to 90 parts by weight of methyl methacrylate and 10 parts by weight of 2-hydroxyethyl methacrylate as methacrylic monomers.

Example 3

In Example 3, a sheet for thermal transcription was prepared in the same way as in Example 1, except using, as a resin contained in the receiving layer, a resin of a graft polymer obtained on graft polymerization of 25 parts by weight of KURARE POLYOL P-1040, an alicyclic polyester with a number average molecular weight of 1000, manufactured by KURARE Co. Ltd., to 90 parts by weight of methyl methacrylate and 10 parts by weight of 2-hydroxyethyl methacrylate as methacrylic monomers.

Example 4

In Example 4, a sheet for thermal transcription was prepared in the same way as in Example 1, except using, as a resin contained in the receiving layer, a resin of a graft polymer obtained on graft polymerization of 25 parts by weight of VYLON200, an aromatic polyester with a number average molecular weight of 17000, manufactured by TOYOBO Co. Ltd., to 90 parts by weight of methyl methacrylate and 10 parts by weight of 2-hydroxyethyl methacrylate as methacrylic monomers.

Example 5

In Example 5, a sheet for thermal transcription was prepared in the same way as in Example 1, except using, as a resin contained in the receiving layer, a resin of a graft polymer obtained on graft polymerization of 25 parts by weight of the same aliphatic polyester as that of Example 1, to 95 parts by weight of methyl methacrylate and 5 parts by weight of 2-hydroxyethyl methacrylate as methacrylic monomers.

Example 6

In Example 6, a sheet for thermal transcription was prepared in the same way as in Example 1, except using, as a resin contained in the receiving layer, a resin of a graft polymer, obtained on graft polymerization of 25 parts by weight of the same aliphatic polyester as that of Example 1, to 50 parts by weight of methyl methacrylate and 50 parts by weight of 2-hydroxyethyl methacrylate, as methacrylic monomers.

Example 7

In Example 7, a sheet for thermal transcription was prepared in the same way as in Example 1, except using, as a resin contained in the receiving layer, a resin of a graft polymer, obtained on graft polymerization of 25 parts by weight of the same aliphatic polyester as that of Example 1, to 90 parts by weight of phenoxy ethyl methacrylate and 10 parts by weight of 2-hydroxyethyl methacrylate, as methacrylic monomers.

Example 8

In Example 8, a sheet for thermal transcription was prepared in the same way as in Example 1, except using, as a resin contained in the receiving layer, a resin of a graft polymer, obtained on graft polymerization of 5 parts by weight of the same aliphatic polyester as that of Example 1, to 90 parts by weight of phenoxy ethyl methacrylate and 10 parts by weight of 2-hydroxyethyl methacrylate as methacrylic monomers.

Example 9

In Example 9, a sheet for thermal transcription was prepared in the same way as in Example 1, except using, as a resin contained in the receiving layer, a resin of a graft polymer, obtained on graft polymerization of 50 parts by weight of the same aliphatic polyester as that of Example 1, to 90 parts by weight of phenoxy ethyl methacrylate and 10 parts by weight of 2-hydroxyethyl methacrylate as methacrylic monomers.

Example 10

In Example 10, a sheet for thermal transcription was prepared in the same way as in Example 1, except using, as a resin contained in the receiving layer, a resin of a graft polymer obtained on graft polymerization of 25 parts by weight of the same aliphatic polyester as that of Example 1, to 80 parts by weight of phenoxy ethyl methacrylate as a methacrylic monomer and 20 parts by weight of 2-hydroxy-3-phenoxypropyl acrylate as an acrylic monomer.

Example 11

In Example 11, a sheet for thermal transcription was prepared in the same way as in Example 1, except using, as a resin contained in the receiving layer, a resin of a graft polymer, obtained on graft polymerization of 25 parts by weight of the same aliphatic polyester as that of Example 1, to 90 parts by weight of ethyl methacrylate and 10 parts by weight of 2-hydroxyethyl methacrylate, as methacrylic monomers.

Example 12

In Example 12, a sheet for thermal transcription was prepared in the same way as in Example 1, except using, as a resin contained in the receiving layer, a resin of a graft polymer, obtained on graft polymerization of 25 parts by weight of the same aliphatic polyester as that of Example 1, to 90 parts by weight of cyclohexyl methacrylate and 10 parts by weight of 2-hydroxyethyl methacrylate, as methacrylic monomers.

Example 13

In Example 13, a sheet for thermal transcription was prepared in the same way as in Example 1, except using, as a resin contained in the receiving layer, a resin of a graft polymer, obtained on graft polymerization of 25 parts by weight of the same aliphatic polyester as that of Example 1, to 90 parts by weight of isoboronyl methacrylate and 10 parts by weight of 2-hydroxyethyl methacrylate, as methacrylic monomers.

Example 14

In Example 14, a sheet for thermal transcription was prepared in the same way as in Example 1, except using, as a resin contained in the receiving layer, a resin of a graft polymer, obtained on graft polymerization of 25 parts by weight of the same aliphatic polyester as that of Example 1, to 90 parts by weight of tertiary butyl methacrylate and 10 parts by weight of 2-hydroxyethyl methacrylate, as methacrylic monomers.

Example 15

In Example 15, a sheet for thermal transcription was prepared in the same way as in Example 1, except using, as a resin contained in the receiving layer, a resin of a graft polymer obtained on graft polymerization of 25 parts by weight of the same aliphatic polyester as that of Example 1, to 90 parts by weight of phenoxy methacrylate and 10 parts by weight of 2-hydroxyethyl methacrylate, as methacrylic monomers.

Example 16

In Example 16, a sheet for thermal transcription was prepared in the same way as in Example 1, except using, as a resin contained in the receiving layer, a resin of a graft polymer, obtained on graft polymerization of 10 parts by weight of an aliphatic polyester and 10 parts by weight of an alicyclic polyester, to 90 parts by weight of methyl methacrylate and 10 parts by weight of 2-hydroxyethyl methacrylate as methacrylic monomers.

Comparative Example 1

In Comparative Example 1, a sheet for thermal transcription was prepared in the same way as in Example 1, except preparing, as a resin contained in the receiving layer, a copolymer resin obtained on homopolymerization of methyl methacrylate, and using 100 parts by weight of this copolymer resin.

Comparative Example 2

In Comparative Example 2, a sheet for thermal transcription was prepared in the same way as in Example 1, except using 100 parts by weight of the same aliphatic polyester as that used in Example 1, as a resin contained in the receiving layer.

Comparative Example 3

In Comparative Example 3, a sheet for thermal transcription was prepared in the same way as in Example 1, except using, as a resin contained in the receiving layer, 100 parts by weight of the same aromatic polyester as that used in Example 4.

Comparative Example 4

In Comparative Example 4, a sheet for thermal transcription was prepared in the same way as in Example 1, except using, as a resin contained in the receiving layer, 100 parts by weight of the same alicyclic polyester as that used in Example 3.

For the sheets for thermal transcription of the Examples 1 to 16 and Comparative Examples 1 to 4, prepared as described above, evaluation was made of the printing density (MAX O.D.), bleeding on storage under high temperature conditions, light fastness, running performance under high temperature conditions, micro-cracking and the transfer performance of a laminate film.

Specifically, in evaluating the printing density, gradation printing was made on each sheet for thermal transcription, using a UP-DR100 printer, a thermal transcription printer manufactured by SONY CORPORATION, dyes for yellow (Y), magenta (M) and cyan (C), and UPC-46, an ink ribbon with a laminate film (L), manufactured by SONY CORPORATION. The printing density (MAX O.D.) was measured and evaluated using a Macbeth reflection densitometer (TR-924).

In evaluating the bleeding, a line about 1 mm wide was printed on each sheet for thermal transcription, using the same thermal transcription printer and ink ribbon as those used for evaluating the printing density, and measurement was made of the line width. The measured result was set as L0. The printed sheets were stored for one month under a 60° C.-85% environment. The image width after storage was measured and set as L1. The bleeding ratio (%) was calculated for evaluation, using a calculation equation:

$$\text{bleeding ratio (\%)}=(L1-L0)/L0\times 100$$

In evaluating light fastness, gradation printing was made using a thermal transcription printer and an ink ribbon which are the same as those used in evaluating the printing density. Gradation printing was then carried out and, using a Macbeth reflection densitometer (TR-924), the density was measured. The measured result was set as $OD_0$. The printed image was irradiated with xenon (90000 kJ), using a xenon long life weather meter, manufactured by SUGA SIKEN Co. Ltd., and measurement was again made using a Macbeth densitometer. The measured result after xenon irradiation was set as $OD_1$. From the density before xenon irradiation $OD_0$ and that after xenon irradiation $OD_1$, the fading rate was calculated by the following equation:

$$\text{fading rate (\%)}=(OD_0-OD_1)/OD_0\times 100$$

to evaluate light fastness.

In evaluating the running performance under high temperature conditions, the sheets for thermal transcription were allowed to stand sufficiently under an environment of a temperature of 50° C. and a relative humidity of 50%. Then, using the thermal transcription printer and the ink ribbon, which were the same as those used for evaluating the printing density, ten images were printed on end with black all-over printing. The running performance at this time was visually observed for evaluation.

In evaluating the micro cracking, each sheet for thermal transcription was bent and the degree of micro-cracking, caused at this time, was visually observed for evaluation.

In evaluating the transcription performance of a laminate film, a thermal transcription printer and an ink ribbon, similar to those used for evaluating the sheet for thermal transcription, were used. A laminate film was cut and stuck on a yellow part of an ink ribbon, and only yellow data were printed to 16 gradations. Laminate gradation print samples were prepared and the laminate transcription performance was observed for evaluation based on laminate transfer gradations of the image. Table 1 summarizes data of the sheets for thermal transcription of the Examples 1 to 16 and the Comparative Examples 1 to 5, while Table 2 summarizes the results of evaluation of the respective sheets for thermal transcription.

TABLE 1

| | Monomer sorts (acrylic, methacrylic) | Monomer content (parts by weight) | Polyester sorts | Polyester content (parts by weight) |
|---|---|---|---|---|
| Ex. 1 | Methyl methacrylate | 100 | Aliphatic polyester | 25 |
| Ex. 2 | Methyl methacrylate | 90 | Aliphatic polyester | 25 |
| | 2-hydroxyethyl methacrylate | 10 | | |
| Ex. 3 | Methyl methacrylate | 90 | Alicyclic polyester | 25 |
| | 2-hydroxyethyl methacrylate | 10 | | |
| Ex. 4 | Methyl methacrylate | 90 | Aromatic polyester | 25 |
| | 2-hydroxyethyl methacrylate | 10 | | |
| Ex. 5 | Methyl methacrylate | 95 | Aliphatic polyester | 25 |
| | 2-hydroxyethyl methacrylate | 5 | | |
| Ex. 6 | Methyl methacrylate | 50 | Aliphatic polyester | 25 |
| | 2-hydroxyethyl methacrylate | 50 | | |
| Ex. 7 | Phenoxyethyl methacrylate | 90 | Aliphatic polyester | 25 |
| | 2-hydroxyethyl methacrylate | 10 | | |
| Ex. 8 | Phenoxyethyl methacrylate | 90 | Aliphatic polyester | 5 |
| | 2-hydroxyethyl methacrylate | 10 | | |
| Ex. 9 | Phenoxyethyl methacrylate | 90 | Aliphatic polyester | 50 |
| | 2-hydroxyethyl methacrylate | 10 | | |
| Ex. 10 | Phenoxyethyl methacrylate | 80 | Aliphatic polyester | 25 |
| | 2-hydroxy-3-phenoxypropyl acrylate | 20 | | |
| Ex. 11 | Ethyl methacrylate | 90 | Aliphatic polyester | 25 |
| | 2-hydroxyethyl methacrylate | 10 | | |
| Ex. 12 | Cyclohexyl methacrylate | 90 | Aliphatic polyester | 25 |
| | 2-hydroxyethyl methacrylate | 10 | | |
| Ex. 13 | Isoboronyl methacrylate | 90 | Aliphatic polyester | 25 |
| | 2-hydroxyethyl methacrylate | 10 | | |
| Ex. 14 | Tertiary butyl methacrylate | 90 | Aliphatic polyester | 25 |
| | 2-hydroxyethyl methacrylate | 10 | | |
| Ex. 15 | Phenoxy methacrylate | 90 | Aliphatic polyester | 25 |
| | 2-hydroxyethyl methacrylate | 10 | | |
| Ex. 16 | Methyl methacrylate | 90 | Aliphatic polyester | 10 |
| | 2-hydroxyethyl methacrylate | 10 | Alicyclic polyester | 10 |
| Comp. Ex. 1 | Methyl methacrylate | 100 | — | — |
| Comp. Ex. 2 | — | — | Aliphatic polyester | 100 |
| Comp. Ex. 3 | — | — | Aromatic polyester | 100 |
| Comp. Ex. 4 | — | — | Alicyclic polyester | 100 |

TABLE 2

| | MAX O.D | Bleeding | Light fastness | Running performance | Micro-crack | Transfer performance of laminate film |
|---|---|---|---|---|---|---|
| Ex. 1 | ○ | ◎ | ◎ | ◎ | ○ | ○ |
| Ex. 2 | ◎ | ◎ | ◎ | ◎ | ◎ | ◎ |
| Ex. 3 | ○ | ◎ | ○ | ◎ | ◎ | ◎ |
| Ex. 4 | ○ | ◎ | ○ | ◎ | ○ | ◎ |
| Ex. 5 | ○ | ◎ | ◎ | ◎ | ○ | ○ |
| Ex. 6 | ○ | ○ | ○ | ○ | ◎ | ◎ |
| Ex. 7 | ◎ | ○ | ◎ | ◎ | ◎ | ◎ |
| Ex. 8 | ○ | ◎ | ◎ | ◎ | ○ | ◎ |
| Ex. 9 | ◎ | ○ | ○ | ○ | ◎ | ○ |
| Ex. 10 | ◎ | ○ | ◎ | ○ | ◎ | ◎ |
| Ex. 11 | ◎ | ◎ | ◎ | ◎ | ◎ | ○ |
| Ex. 12 | ○ | ◎ | ○ | ◎ | ○ | ○ |
| Ex. 13 | ○ | ◎ | ○ | ◎ | ○ | ○ |
| Ex. 14 | ○ | ◎ | ○ | ◎ | ○ | ○ |
| Ex. 15 | ○ | ◎ | ○ | ◎ | ○ | ○ |
| Ex. 16 | ◎ | ◎ | ◎ | ◎ | ◎ | ◎ |
| Comp. Ex. 1 | X | ◎ | ○ | ◎ | X | Δ |
| Comp. Ex. 2 | ◎ | X | ◎ | X | ◎ | X |
| Comp. Ex. 3 | ○ | ◎ | X | ○ | ◎ | X |
| Comp. Ex. 4 | ◎ | Δ | ○ | Δ | ◎ | X |

Turning to the evaluation of printing density in Table 2, a symbol ◎ stands for a value of MAX O.D. not less than 2.30 and a symbol ○ stands for a value of MAX O.D. not less than 2.10 and less than 2.30. A symbol Δ stands for a value of MAX O.D. not less than 1.95 and less than 2.10 and a symbol X stands for a value of MAX O.D. less than 1.95. In Table 1, a sheet for thermal transcription with the value of MAX .O.D. not less than 2.10, thus marked with the symbol ◎ or ○, was deemed to be of high dyeability, with the dye coloring to a predetermined density. Conversely, a sheet for thermal transcription with the value of MAX O.D. less than 2.10, thus marked with the symbol Δ or X, was deemed to be of low dyeability, with the dye not coloring to a predetermined density.

In evaluating the bleeding, in Table 2, a symbol ◎ stands for a bleeding ratio not higher than 5%, a symbol ○ stands for a bleeding ratio higher than 5% and not higher than 25%, and a symbol X stands for a bleeding ratio higher than 25%. As for bleeding, it is deemed that, in a sheet for thermal transcription with the result of evaluation of the symbols ◎ and ○, its bleeding can be suppressed under high temperature high humidity environments. On the other hand, it is deemed that, in a sheet for thermal transcription with the result of evaluation of the symbol X, its bleeding cannot be suppressed under high temperature high humidity environments.

In evaluating light fastness in Table 2, a symbol ◎ stands for a value of a fading ratio not higher than 5% and a symbol ○ stands for a value of a fading ratio higher than 5% and not higher than 15%. A symbol X stands for a value of the fading ratio higher than 15%. In evaluating light fastness, with a sheet for thermal transcription marked with the symbol ◎ or ○, its fading was deemed to be suppressed. Conversely, with a sheet for thermal transcription marked with the symbol X, its fading was deemed to be not suppressed.

In evaluating the running performance, in Table 2, a symbol ◎ stands for there being no problem in running performance, and a symbol ○ stands for there being slight foreign sound during detachment of an ink ribbon but there being no defects such as a detachment line being generated in a produced image. A symbol Δ stands for there being foreign noise during running, and a detachment line, for example, being generated in the generated image to detract from the image quality. Δ symbol X stands for an ink ribbon being fused and stuck or the receiving layer becoming detached from a substrate thus causing running troubles. In evaluating the running performance, a sheet for thermal transcription with the result of evaluation of the symbols ◎ and ○, is deemed to be stable in running performance. On the other hand, a sheet for thermal transcription with the result of evaluation on the running performance of the symbols Δ and X, is deemed to be poor in running performance.

In evaluating micro-cracking, in Table 2, a symbol ◎ stands for there being produced no micro-cracks, and a symbol ○ stands for there being slight micro-cracks but the image quality not being thereby impaired. A symbol Δ stands for there being cracking noise and there being cracks generated on the entire surface to detract from the image quality, and a symbol X stands for there being cracking noise with the receiving layer disengaging from the substrate. In evaluating the micro-cracking, a sheet for thermal transcription with the result of evaluation for the micro-cracking with the symbols ◎ and ○ is deemed to be usable as a sheet for thermal transcription. On the other hand, a sheet for thermal transcription with the result of evaluation on the micro-cracking being Δ and X, is deemed to be not usable with ease as a sheet for thermal transcription.

In evaluating the laminate adhesion performance, in Table 2, a symbol ◎ stands for the laminate transfer gradation being not higher than seventh gradation, and a symbol ○ stands for the laminate transfer gradation being higher than seventh gradation and not being higher than eleventh gradation. A symbol Δ stands for the laminate transfer gradation being higher than eleventh gradation and being not higher than sixteenth gradation. A symbol X stands for there being no laminate transfer.

It is seen from the results of evaluation shown in Table 2 that the Examples 1 to 16, in which a graft copolymer of one or more of acrylic and methacrylic monomers and one or more of polyesters is contained in the receiving layers, were acceptable in all of items of evaluation of the printing density (MAX O.D.), bleeding on storage under high temperature conditions, light fastness, running performance under high temperature conditions, micro-cracking and transfer performance of a laminate film.

In the Examples 1 to 16, the methacrylic or acrylic monomers, such as methyl methacrylate, 2-hydroxyethyl methacrylate or 2-hydroxy-3-phenoxy propyl acrylate, used as a main chain of the graft polymer, improve the detachment performance of the thermal transcription sheet under high temperature conditions, while assuring stabilized running performance. In addition, in the Examples 1 to 16, the methacrylic or acrylic monomers improve the adhesion characteristics of the laminate film and light fastness of the light receiving layer to prevent the dye from fading.

Moreover, in the Examples 1 to 16, the polyesters as side chains of the graft polymer, such as aliphatic, alicyclic or aromatic polyesters, improve the printing density and prevent the image from bleeding under elevated temperatures, while preventing cracking in the receiving layer.

Thus, in the Examples 1 to 16, in which a graft polymer of at least one monomer out of the methacrylic and acrylic monomers and at least one polyester sort is contained in the receiving layer, it is possible to obtain acceptable values of the printing density or adhesion characteristics of the laminate films. In addition, it is possible to prevent bleeding or fading of the image and cracking, as well as to assure the stabilized running performance.

In the Comparative Example 1, as contrasted to the above Examples, in which polyester is not contained and only a resin obtained on copolymerizing methyl methacrylate is contained in the receiving layer, the transfer sensitivity is not improved, while the printing density is lowered. Moreover, in the Comparative Example 1, cracking tends to be developed on warping the receiving layer, due to brittleness of methyl methacrylate that makes up the resin.

In the Comparative Example 2, in which acrylic or methacrylic monomers are not contained and a resin composed only of an aliphatic polyester is contained in the receiving layer, the ink ribbon tends to be fused to the receiving layer under high temperature conditions, with the result that the ink ribbon is inferior in detachment characteristics, thus lowering the running performance. In addition, in the Comparative Example 2, containing the resin formed only of the aliphatic polyester, the laminate film becomes inferior in the transcription performance. Moreover, bleeding occurs on image storage under high temperature conditions.

In the Comparative Example 3, in which no acrylic or methacrylic monomers are contained but only a resin composed of an aromatic polyester is contained in the receiving layer, the laminate film is lowered in the transcription performance. In addition, the image is lowered in light fastness due to content of the aromatic compound of the aromatic polyester.

In the Comparative Example 4, in which no acrylic or methacrylic monomers are contained but only a resin composed of an alicyclic polyester is contained in the receiving layer, the laminate film is lowered in the transcription performance. Moreover, in the Comparative Example 4, not containing acrylic monomers or methacrylic monomers, the running performance under high temperature conditions is deteriorated, while bleeding is produced.

It is seen from above that, in case a graft polymer of at least one monomer out of methacrylic monomers and acrylic monomers and at least one polyester sort is contained in a receiving layer, in fabricating a sheet for thermal transcription, it is possible to produce a receiving layer having satisfactory printing density and satisfactory adhesion performance with respect to a laminate film. Additionally, with the so generated receiving layer, the running performance is stabilized, while bleeding or fading of the image as well as cracking may be prevented from occurring.

INDUSTRIAL UTILIZABILITY

The present invention contributes to generation of an image of high quality and high resolution, because satisfactory printing density or satisfactory adhesion performance of the laminate film as well as stabilized running performance may be achieved, and image bleeding or fading may be prevented from occurring.

The invention claimed is:

1. A sheet for thermal transcription comprising:

a substrate; and a receiving layer formed on said substrate for receiving a dye, wherein, said receiving layer comprises a graft polymer having a main chain consisting of at least one monomer selected from the group consisting of acrylic monomers and methacrylic monomers and a side chain of at least one polyester.

2. The sheet for thermal transcription according to claim 1 wherein said at least one monomer includes a monomer shown by the following chemical formula 1:

(1)

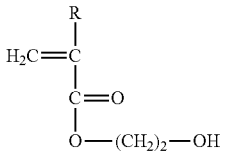

where R represents H or $CH_3$.

3. The sheet for thermal transcription according to claim 1 wherein said at least one monomer includes a monomer shown by the following chemical formula 2:

[Chemical formula 2]

(2)

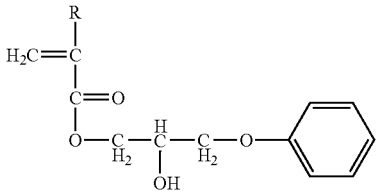

where R represents H or $CH_3$.

4. The sheet for thermal transcription according to claim 1 wherein said at least one monomer includes at least one selected from the group consisting of methyl acrylate, ethyl acrylate, cyclohexyl acrylate, isoboronyl acrylate, tertiary butyl acrylate, phenoxy acrylate, phenoxy ethyl acrylate, methyl methacrylate, ethyl methacrylate, cyclohexyl methacrylate, isoboronyl methacrylate, tertiary butyl methacrylate, phenoxy methacrylate and phenoxy ethyl methacrylate.

5. The sheet for thermal transcription according to claim 1 wherein said at least one polyester in the graft polymer is an aromatic polyester, an aliphatic polyester, an alicyclic polyester or combinations thereof.

6. The sheet for thermal transcription according to claim 1 wherein said graft polymer is composed of 5 parts by weight to 50 parts by weight of said at least one polyester based upon 100 parts by weight of said at least one monomer.

7. The sheet for thermal transcription according to claim 2 wherein the ratio of parts by weight of said monomer represented by the chemical formula 1 to the parts by weight of the total weight of said at least one monomer except for said monomer represented by the chemical formula 1 is 5:95 to 50:50.

* * * * *